US005666756A

United States Patent [19]

Moller

[11] Patent Number: 5,666,756

[45] Date of Patent: Sep. 16, 1997

[54] SHOTGUN HAVING LIGHT WEIGHT INTERCHANGEABLE BARREL TUBES WITH IMPROVED FIT

[75] Inventor: Clifford Moller, Houston, Tex.

[73] Assignee: Briley Manufacturing Co., Houston, Tex.

[21] Appl. No.: 495,937

[22] Filed: Jun. 28, 1995

[51] Int. Cl.[6] ..... F41A 21/00

[52] U.S. Cl. ..... 42/77; 42/76.01; 42/79; 42/78; 42/47

[58] Field of Search ..... 42/77, 76.01, 79, 42/78, 47; 217/110

[56] References Cited

U.S. PATENT DOCUMENTS

| | | | |
|---|---|---|---|
| 282,194 | 7/1883 | Howe | 42/77 |
| 1,759,772 | 5/1930 | Williams | 42/77 |
| 2,837,028 | 6/1958 | Fransson | 102/446 |
| 3,747,247 | 7/1973 | McNair | 42/1 |
| 4,361,093 | 11/1982 | Saxby | 102/447 |
| 4,467,546 | 8/1984 | Beretta | 42/79 |
| 4,506,604 | 3/1985 | Huges | 102/446 |
| 4,660,312 | 4/1987 | A'Costa | 42/76.01 |
| 4,887,510 | 12/1989 | Wynn | 89/163 |
| 4,955,157 | 9/1990 | Brighton et al. | 42/77 |
| 4,989,359 | 2/1991 | Kinkner et al. | 42/77 |
| 5,018,293 | 5/1991 | Mainland | 42/77 |
| 5,309,814 | 5/1994 | Mossberg | 89/14.6 |
| 5,448,848 | 9/1995 | Moller | 42/77 |

*Primary Examiner*—Charles T. Jordan
*Assistant Examiner*—Meena Chelliah
*Attorney, Agent, or Firm*—Pravel, Hewitt, Kimball & Krieger

[57] ABSTRACT

A tubular insert for a shotgun such as an over/under shotgun provides a chamber end portion with a smooth outer surface. In order to achieve a good fit between the tubular insert at the chamber end portion and the shotgun barrel at its breech, a polymeric disk member is mounted in a correspondingly sized and shaped socket milled into outer surface of the chamber end portion of the tubular insert. The polymeric disk member extends a distance away from the outer surface of the chamber end portion to create a slight interference fit between the shotgun barrel bore at the breech and the tubular insert at its chamber end portion.

21 Claims, 1 Drawing Sheet

SHOTGUN HAVING LIGHT WEIGHT INTERCHANGEABLE BARREL TUBES WITH IMPROVED FIT

BACKGROUND OF THE INVENTION

1. Field of the Invention

The present invention relates to shotguns and shotgun barrels and more particularly relates to insert tubes for over and under shotguns that fit the barrel, extending substantially the full length thereof to change the choke of the barrel. Even more particularly, the present invention relates to an improved barrel insert tube having an elongated (preferably aluminum) barrel section, and a shorter heavier chamber section (preferably titanium or steel) that includes an outer surface with a socket that carries a plastic projecting member extending slightly above the shaped outer surface of the chamber section for creating a slight interference fit between the bore at the breech chamber and the tube insert at the plastic projection.

2. General Background

On the of the most common types of shotguns used in competitive skeet shooting is the over/under type shotgun. This shotgun includes two barrels that are vertically aligned and a breech portion that breaks open to expose the chamber ends of the barrels. Such over and under shotguns are well known in the art, manufactured and sold by a number of large gun manufactures such as Browning, Berreta, Windchester, and Remington.

It is known in the art to place a long tubular insert within one or both of these barrels for changing the choke of the barrel. An example of such a tubular insert that changes the choke of the barrel can be seen in U.S. Pat. Nos. 4,989,359 and 5,018,293.

SUMMARY OF THE INVENTION

The present invention provides an improved shotgun barrel tube insert that is sized and shaped to fit within the cylindrical bore of a shotgun barrel.

The present invention provides a plastic disk member that is affixed to the outer surface of the barrel insert, preferably at the chamber end portion thereof.

The present invention provides an elongated shotgun barrel tube that has chamber and barrel portions, preferably connected with a threaded connection.

The chamber can be formed of a harder metal such as titanium or stainless steel. The elongated barrel portion of the insert tube can be formed of an aluminum alloy.

The plastic member is preferably a circular disk shaped plug member of polymeric material such as nylon. A socket on the chamber portion of the tube insert receives the plastic plug or disk.

The socket is sized and shaped to conform to the outer surface of the disk at the disk bottom and side. However, the top of the disk extends beyond the outer surface of the tubular insert. When the tubular insert is placed within the barrel of the shotgun, the projecting plastic member presses against the inside of the shotgun barrel creating a slight interference fit between the tubular insert and the shotgun barrel bore at the plastic disk. The disk is preferably of a plastic material that can deflect somewhat. Through deformable to a degree, the disk is of a relatively hard plastic (e.g. nylon) so that it can be used over and over again.

The present invention thus provides an improvement to tubular inserts for shotguns in that the apparatus of the present invention can be used in any shotgun notwithstanding slight variations in dimensions from one shotgun to the next. Thus, significant expense is saved over prior art methods of manufacturing of tubular inserts of shotguns that require exact tolerances.

With the present invention, the plastic disk occupies any space that might otherwise cause a sloppy fit between a tubular insert and the shotgun barrel. Because the insert is made of a plastic material, it can deform slightly if necessary to fit a particular shotgun barrel into which it is inserted.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figures 1, 2, 3, 4, 5, 6, 7, 8, 8A, 9:
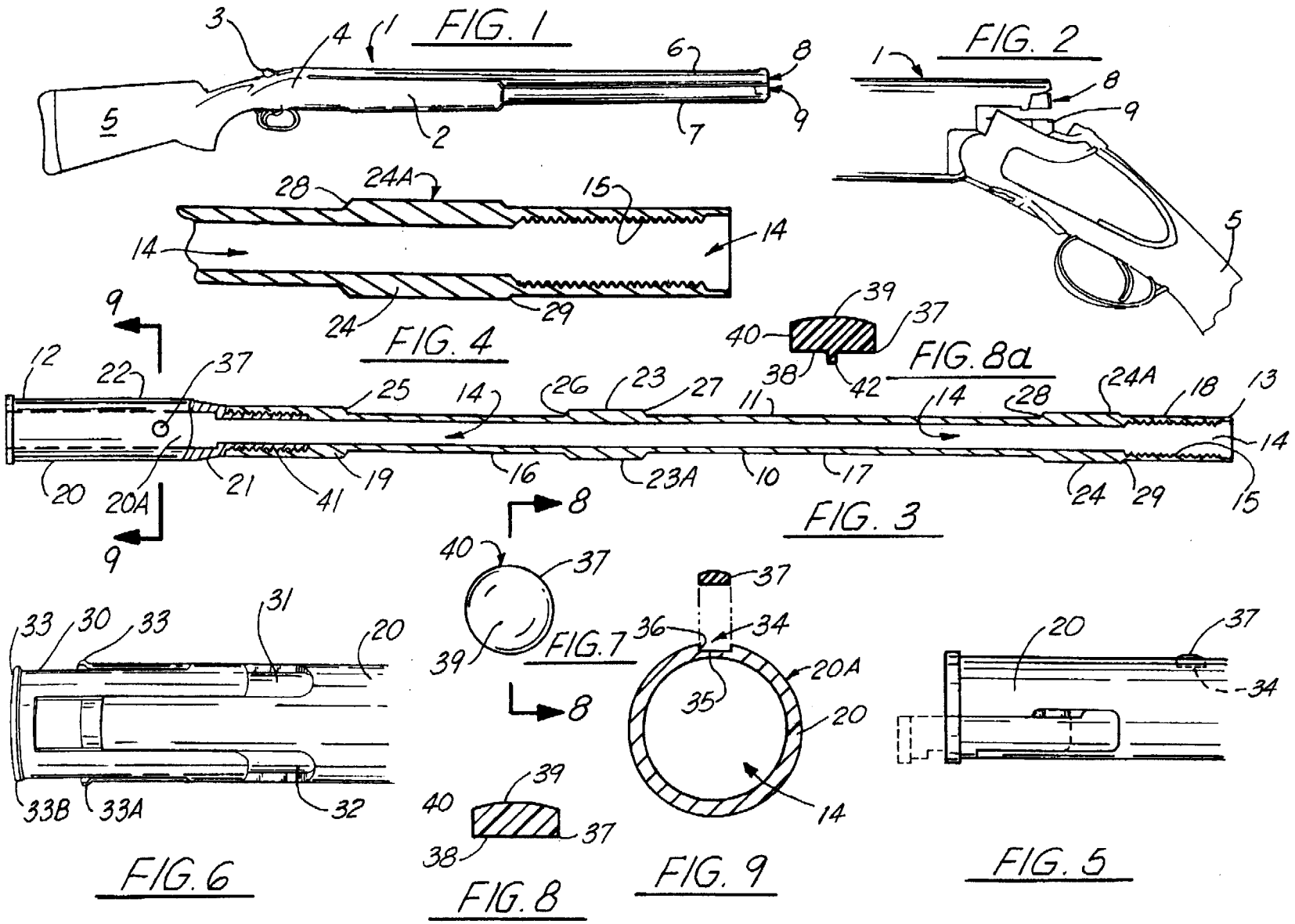
FIGS. 1–2 are side views illustrating a typical over and under style shotgun shown in closed (FIG. 1) and in open (FIG. 2) positions.
FIG. 3 is a side sectional view of the preferred embodiment of the apparatus of the present invention.
FIG. 4 is a fragmentary side sectional view of the preferred embodiment of the apparatus of the present invention showing the muzzle end portion thereof.
FIG. 5 is another fragmentary side view of the preferred embodiment of the apparatus of the present invention showing the chamber end.
FIG. 6 is another fragmentary view of the preferred embodiment of the apparatus of the present invention illustrating the chamber end.
FIG. 7 is a fragmentary top view illustrating the plastic insert portion of the preferred embodiment of the apparatus of the present invention.
FIG. 8 is a sectional view taken along lines 8—8 of FIG. 7.
FIG. 8A is a sectional view illustrating an alternate construction of the plastic insert portion.
FIG. 9 is sectional view taken along lines 9—9 of FIG. 3.

FIGS. 1 and 2 show generally a typical over and under shotgun 1 having a forearm 2, lever 3 for opening the shotgun, breech 4, stock 5 and vertically aligned barrels 6, 7. The barrels 6, 7 each have elongated open ended bores 8, 9 respectively.

FIGS. 3–9 show the preferred embodiment of the apparatus of the present invention designated generally by the numeral 10 in FIG. 3. Shotgun barrel insert 10 has a chamber end 12, a muzzle end 13, an elongated tubular body section 11, (preferably aluminum) and a chamber section 20 (preferably titanium or stainless steel). Insert 10 is hollow, providing an elongated smooth continuous bore 14.

The bore 14 has an internally threaded section 15 adjacent the muzzle 13 end of the tubular body 11. This internally threaded section 15 can be optionally provided for accepting a selected choke tube that changes the choke of the shotgun to full choke, skeet, modified, improved cylinder or the like.

In FIGS. 3–6, tubular body 11 includes a number of differing sections of differing diameter. A pair smaller of diameter sections 16, 17 are the longest sections of the tubular body 11. A pair of larger diameter sections 18, 19 are placed at end portions of tubular body 11. The first larger diameter section 18 is at the muzzle end portion 13 and is provided as a reinforcement to the internally threaded section 15. The larger diameter section 19 is adjacent chamber section 20 and provides a reinforcement for the threaded connection 41 that joins tubular body section 11 and chamber section 20.

Chamber section 20 has differing shaped sections as shown in FIGS. 3, 5 and 6. At the connection between the chamber section 20 and the section 11, a frustroconical section 21 is provided. Chamber section 20 also includes a generally cylindrical section 22. Section 22 is actually slightly tapered, beginning with a smaller diameter at the frustroconical section 21 and gradually increasing in diameter toward the chamber end 12 of insert tube 10. This taper is preferably every small, for example less than one degree of taper, e.g. eight nine minutes of taper.

A pair of annular ribs 23, 24 can be provided along the length of tubular body 11, providing reinforcement and defining an outer rib surfaces 23A, 24A respectively for engaging the bore 8 or 9 of the selected barrel 6 or 7 of shotgun 1.

An annular shoulder 25 defines the intersection between smaller diameter section 16 and larger diameter section 19. Annular shoulder 26 is positioned between annular rib 23 and smaller diameter section 16. Annular shoulder 27 is positioned between annular rib 23 and smaller diameter section 17. Annular shoulder 28 is positioned between smaller diameter section 17 and annular rib 24. Annular shoulder 29 is positioned between annular rib 24 and larger diameter section 18.

Chamber end 20 includes an ejector 30 that is mounted in a pair of milled slots 31, 32. Annular shoulder 33 includes sections 33A and 33B, the section 33B traveling with the ejector 30. The section 33A is a rigid portion integrally formed with the chamber 20.

In FIGS. 8, 8A–8B and 9, plastic disk member 37 and its socket 34 are shown. Socket 34 is formed on the outer surface 20A of chamber section 20. Socket 34 can be generally circular in shape. Socket 34 has a thickness that extends only a partial distance through chamber 20 between outer surface 20A the bore 14 of insert 10. Socket 34 thus has an inner flat circular surface 35 and a peripheral side wall 36.

A plastic disk member 37 occupies recess 34. Disk 37 is preferably polymeric material having high wear and abrasion resistance and a low coefficient of function. Disk member 37 can be manufactured of a material such as nylon or the like, one example being POLYPENCO® NYLON 101, available from Regal Plastic Company of Houston, Tex. In FIGS. 8–8A, disk 37 has an inner surface 38 that fits inner surface 35 of socket 34, and outer curved surface 39 that generally tracks the curvature of the outer surface 20A of chamber section 20. Disk 37 includes an annular peripheral side wall 40 that generally tracks peripheral side wall 36 of recess 34. In FIG. 8A, disk 37 can be provided with a stem 42 that would fit a correspondingly sized and shaped cylindrical portion of socket 34. Disk 37 is preferably glued to socket 34 using a cement such as LOCKTITE® RC 680.

The following table lists the parts numbers and parts descriptions as used herein and in the drawings attached hereto.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. An improved shotgun barrel tube sized and shaped to fit within a cylindrical shotgun barrel support having an inner supporting surface, the barrel tube including an enlarged diameter chamber portion for receiving a shotgun shell with a chamber outer surface and an elongated barrel portion with a cylindrical internal bore, the chamber and elongated barrel having outer surface portions that engage each end of the barrel support and at least one place along the length of the elongated portion which engages the barrel support, the improvement comprising:

a) a plug member that is affixed to the barrel tube at the chamber outer surface, extending therefrom along a radial line a short distance;

b) the plug member extending a partial distance circumferentially around the chamber portion outer surface: and c) wherein the barrel tube outer surface directly engages, the barrel support at positions spaced away from the plug member.

2. The improved shotgun barrel tube of claim 1, wherein the chamber and elongated barrel portions are formed as separate components with cooperating threads for joining them.

3. The improved shotgun barrel tube of claim 2 wherein the chamber is formed of a titanium alloy.

4. The improved shotgun barrel tube of claim 2, wherein the chamber portion is formed of stainless steel.

5. The improved shotgun barrel tube of claim 2, wherein the elongated barrel portion is formed of an aluminum alloy.

6. The improved shotgun barrel of claim 1 wherein the plug member is of a polymeric material.

7. The improved shotgun barrel of claim 1 further comprising a closed socket on the chamber that communicates with the outer surface, and said plug member occupies said socket.

8. The improved shotgun barrel of claim 7 wherein said plug member is glued to said socket.

9. An improved shotgun barrel and insert apparatus comprising:

a) a shotgun having a barrel, with a breech and an elongated bore;

b) a barrel tube insert member that fits the breech and bore of the shotgun barrel, the insert member including an enlarged diameter chamber portion for receiving a shotgun shell and an elongated insert barrel portion with a cylindrical internal insert bore;

c) the chamber and elongated insert barrel having enlarged outer diameter portions at each end of the barrel tube insert;

d) the chamber having a smooth, curved outer surface;

e) a recess formed on the chamber at its outer surface, the recess extending a short circumferential distance about the chamber outer surface; and f) a plug member that is affixed to the chamber occupying the recess and extending along a radial line from the outer surface a short distance.

10. The improved shotgun barrel of claim 9 wherein the plug member is a disk having a diameter smaller than the internal diameter of the insert bore.

11. The improved shotgun barrel of claim 9 wherein the plug is plastic.

12. The improved shotgun barrel of claim 9 wherein the plug member is flexible.

13. The improved shotgun barrel tube of claim 9, wherein the chamber and elongated barrel portions are formed as separate components with cooperating threads for joining them.

14. The improved shotgun barrel tube of claim 9 wherein the chamber has a frustroconically shaped section.

15. The improved shotgun barrel tube of claim 9, wherein the chamber portion is formed of a material selected from the group consisting of stainless steel and titanium alloy.

16. The improved shotgun barrel tube of claim 9, wherein the elongated barrel portion is formed of an aluminum alloy.

17. The improved shotgun barrel of claim 12 wherein the plug member is of a polymeric material.

18. The improved shotgun barrel of claim 12 wherein the recess comprises a closed socket on the chamber that communicates with the outer surface, and said flexible member occupies said socket.

19. The improved shotgun barrel of claim 12 wherein said plug member is glued to said socket.

20. The improved shotgun barrel of claim 17 wherein said polymeric plug member is glued to said socket.

21. An improved shotgun barrel tube having an outer surface sized and shaped to fit within a cylindrical barrel support, the barrel tube including an enlarged diameter chamber portion for receiving and ejecting therefrom a shotgun shell, and including an elongated barrel portion with a cylindrical internal bore, the chamber portion and elongated barrel portion having outer surface portions and enlarged diameter portions of the barrel tube and at least one place along the length of the elongated portion which engage the barrel support, the improvement comprising:

a plastic projecting plug member supported on an outer surface of the barrel tube at the chamber, said plug member having a portion that extends above the surface of the chamber portion outer surface, whereby the projecting member forms a slight interference fit between the outer surface of the barrel tube at the chamber portion thereof, the opposing surface of the barrel tube from the plug member fitting tightly against the cylindrical barrel support; and wherein the barrel tube receives and ejects shotgun shells during use, remaining fixedly secured within the cylindrical barrel support.

* * * * *